US010106762B2

(12) United States Patent
Batchelor et al.

(10) Patent No.: US 10,106,762 B2
(45) Date of Patent: Oct. 23, 2018

(54) TREATING A TEXTILE GARMENT WITH A HYDROPHOBIC DYE SOLUTION

(71) Applicant: Henkel IP & Holding GmbH, Düsseldorf (DE)

(72) Inventors: Stephen Norman Batchelor, Merseyside (GB); Jayne Michelle Bird, Merseyside (GB)

(73) Assignee: Henkel IP & Holding GmbH (DE)

( * ) Notice: Subject to any disclaimer, the term of this patent is extended or adjusted under 35 U.S.C. 154(b) by 0 days.

(21) Appl. No.: 15/018,615

(22) Filed: Feb. 8, 2016

(65) Prior Publication Data

US 2016/0348038 A1 Dec. 1, 2016

Related U.S. Application Data

(63) Continuation of application No. 14/269,894, filed on May 5, 2014, which is a continuation of application No. 13/618,577, filed on Sep. 14, 2012, now Pat. No. 8,715,369, which is a continuation of application No. 11/663,578, filed as application No. PCT/EP2005/009846 on Sep. 9, 2005, now Pat. No. 8,268,016.

(30) Foreign Application Priority Data

Sep. 23, 2004 (GB) ..... 0421147.0
Apr. 27, 2005 (GB) ..... 0508484.3

(51) Int. Cl.

| | |
|---|---|
| ***C11D 3/42*** | (2006.01) |
| ***C11D 11/00*** | (2006.01) |
| ***D06P 1/18*** | (2006.01) |
| ***D06P 1/44*** | (2006.01) |
| ***C11D 3/40*** | (2006.01) |
| ***D06P 1/00*** | (2006.01) |
| ***D06P 1/16*** | (2006.01) |
| ***D06F 35/00*** | (2006.01) |

(52) U.S. Cl.

CPC ..... *C11D 3/42* (2013.01); *C11D 3/40* (2013.01); *C11D 11/0017* (2013.01); *D06F 35/005* (2013.01); *D06P 1/0024* (2013.01); *D06P 1/16* (2013.01); *D06P 1/18* (2013.01); *D06P 1/44* (2013.01)

(58) Field of Classification Search

None

See application file for complete search history.

(56) References Cited

U.S. PATENT DOCUMENTS

| | | | | | |
|---|---|---|---|---|---|
| 3,762,859 | A * | 10/1973 | Wixon | C09B 31/057 | 510/320 |
| 3,920,386 | A * | 11/1975 | Beyer | D06P 1/36 | 8/532 |
| 3,958,928 | A * | 5/1976 | Lala | C09B 1/28 | 510/324 |
| 3,995,994 | A * | 12/1976 | Greenhalgh | C09B 29/0805 | 8/639 |
| 4,552,953 | A * | 11/1985 | Buhler | C09B 29/0003 | 534/886 |
| 4,564,673 | A * | 1/1986 | Niwa | C09B 29/0816 | 534/640 |
| 4,950,305 | A * | 8/1990 | Buhler | C09B 29/0003 | 534/630 |
| 4,980,459 | A * | 12/1990 | Rabassa | C09B 41/009 | 106/496 |
| 2005/0288206 | A1* | 12/2005 | Sadlowski | C11D 3/40 | 510/392 |

FOREIGN PATENT DOCUMENTS

| | | | | |
|---|---|---|---|---|
| WO | WO 2005014769 A1 * | 2/2005 | ..... | C11D 3/001 |

* cited by examiner

*Primary Examiner* — Katie L Hammer
(74) *Attorney, Agent, or Firm* — Bojuan Deng

(57) ABSTRACT

The present invention provides a method for treating a textile garment with a hydrophobic dye solution.

9 Claims, No Drawings

TREATING A TEXTILE GARMENT WITH A HYDROPHOBIC DYE SOLUTION

This is a continuation of application Ser. No. 14/269,894, filing date: May 5, 2014, which is a continuation of application Ser. No. 13/618,577, filing date: Sep. 14, 2012, which is a continuation of application Ser. No. 11/663,578, § 371 date: Mar. 23, 2007, which is the U.S. National Phase of International Application No. PCT/EP2005/09846, filed Sep. 9, 2005, which claims priority to GB 0508484.3, filed Apr. 27, 2005, and GB 0421147.0, filed. Sep. 23, 2004, the entire contents of each are hereby incorporated by reference in their entirety.

TECHNICAL FIELD

The present invention relates to laundry treatment compositions that comprise a dye.

BACKGROUND OF THE INVENTION

Garments comprising polyester fibres are ubiquitous. Many garments are white but over the lifetime of these garments the whiteness is dulled reducing the aesthetic value of the garment. There is a need to maintain the white appearance of such garments such that the aesthetic value is retained as long as possible.

Bleach, fluorescers and shading agents are used in modern wash processes to maintain whiteness. The fluorescers and shading agents that are currently available, do not deposit on polyester fibres of garments to a significant degree. All fibres may be subjected to a bleaching process but over time such treatment can lead to the garment taking a yellow hue.

There is a need to provide technology that maintains and enhances the white appearance of polyester comprising garments.

SUMMARY OF THE INVENTION

Dyes disclosed herein are known to be used to dye textiles in industrial processes conducted at high temperatures together with high concentrations of dyes and dispersion agents. Surprisingly the dyes can be used to shade at low levels of dye and surfactant and at routine laundry temperatures. We have found that hydrophobic dyes are substantive to polyester fibres under normal domestic wash conditions. At low levels of dye a shading whiteness benefit is provided.

In one aspect the present invention provides a laundry treatment composition comprising between 0.0001 to 0.1 wt % of a hydrophobic dye selected from benzodifuranes, methine, triphenylmethanes, napthalimides, pyrazole, napthoquinone and mono-azo or di-azo dyes, and between 2 to 60 wt % of a surfactant. It is preferred that the dye is a mono-azo dye.

In another aspect the present invention provides a method of treating a textile, the method comprising the steps of: (i) treating a textile with an aqueous solution of the hydrophobic dye, the aqueous solution comprising from 1 ppb to 6 ppm of the hydrophobic dye and from 0.2 g/L to 3 g/L of a surfactant; and, (ii) rinsing and drying the textile. It is preferred that the aqueous solution has an ionic strength from 0.001 to 0.5. It is preferred that the hydrophobic dye is present in the range 10 ppb to 200 ppb. In another aspect it is preferred that the aqueous solution also comprises from 1 ppb to 5 ppm one or more other dyes selected from cotton substantive shading dyes of group consisting of: hydrolysed reactive dye; acid dye; and direct dye.

A "unit dose" as used herein is a particular amount of the laundry treatment composition used for a type of wash, conditioning or requisite treatment step. The unit dose may be in the form of a defined volume of powder, granules or tablet or unit dose detergent liquid.

DETAILED DESCRIPTION

Typical dye suppliers may be found in the colour index, and include Clariant, Dystar, Ciba & BASF.

Hydrophobic dyes are defined as organic compounds with a maximum extinction coefficient greater than 1000 L/mol/cm in the wavelength range of 400 to 750 cm and that are uncharged in aqueous solution at a pH in the range from 7 to 11. The hydrophobic dyes are devoid of polar solubilizing groups. In particular the hydrophobic dye does not contain any sulphonic acid, carboxylic acid, or quaternary ammonium groups. The dye chromophore is preferably selected from the group comprising: azo; methine, pyrazole napthoquinone, phthalocyanine; and, triphenylmethane chromophores. Most preferred are azo dye chromophores.

Many examples of hydrophobic dyes are found in the classes of solvent and disperse dyes.

Shading of white garments may be done with any colour depending on consumer preference. Blue and Violet are particularly preferred shades and consequently preferred dyes or mixtures of dyes are ones that give a blue or violet shade on white polyester.

It is preferred that the dye(s) have a peak absorption wavelength of from 550 nm to 650 nm, preferably from 570 nm to 630 nm. A combination of dyes may be used which together have the visual effect on the human eye as a single dye having a peak absorption wavelength on polyester of from 550 nm to 650 nm, preferably from 570 nm to 630 nm. This may be provide for example by mixing a red and green-blue dye to yield a blue or violet shade.

A wide range of suitable solvent and disperse dyes are available. However detailed toxicological studies have shown that a number of such dyes are possible carcinogens, such dyes are not preferred.

Preferred mono-azo dyes are of the form:

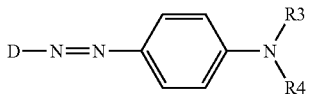

wherein R3 and R4 are optionally substituted C2 to C12 alkyl chains having optionally therein ether (—O—) or ester links, the chain being optionally substituted with —Cl, —Br, —ON, —$NO_2$, and —$SO_2CH_3$; and, D denotes an aromatic or heteroaromatic group. Preferably D is selected from the group consisting of: azothiophenes, azobenzothiazoles and azopyridones.

It is preferred that R3 is —CH2CH2R5 and R4 and is —CH2CH2R6 and R5 and R6 are independently selected from the group consisting of: H, —CN, —OH, —C6H5, —OCOR7 and —COOR7, and that R7 is independently selected from: aryl and alkyl. Preferred aryl are —C6H5 and C10H7.

The following is an example of a preferred class of mono-azo dyes:

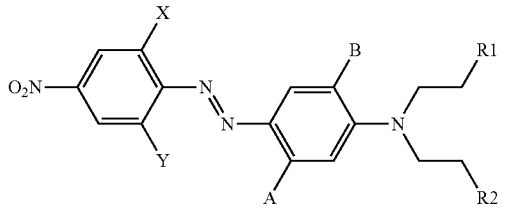

where X and Y are independently selected from the group consisting of: —H, —Cl, —Br, —ON, —$NO_2$, and —$SO_2CH_3$;

A is selected —H, —$CH_3$, —Cl, and —NHCOR;

B is selected —H, —$OCH_3$, —$OC_2H_5$, and —Cl;

$R^1$ and $R^2$ are independently selected from the group consisting of: —H, —ON, —OH, —OCOR, —COOR, -aryl; and R is C1-C8-alkyl.

The following are preferred azo dyes: Disperse blue 10, 11, 12, 21, 30, 33, 36, 38, 42, 43, 44, 47, 79, 79:1, 79:2, 79:3, 32, 85, 88, 90, 94, 96, 100, 101, 102, 106, 106:1, 121, 122, 124, 125, 128, 130, 133, 137, 138, 139, 142, 146, 148, 149, 165, 165:1, 165:2, 165:3, 171, 173, 174, 175, 177, 183, 187, 189, 193, 194, 200, 201, 202, 205, 206, 207, 209, 210, 211, 212, 219, 220, 222, 224, 225, 248, 252, 253, 254, 255, 256, 257, 258, 259, 260, 264, 265, 266, 267, 268, 269, 270, 278, 279, 281, 283, 284, 285, 286, 287, 290, 291, 294, 295, 301, 303, 304, 305, 313, 315, 316, 317, 319, 321, 322, 324, 328, 330, 333, 335, 336, 337, 338, 339, 340, 341, 342, 343, 344, 345, 346, 351, 352, 353, 355, 356, 358, 360, 366, 367, 368, 369, 371, 373, 374, 375, 376 and 378, Disperse Violet 2, 3, 5, 6, 7, 9, 10, 12, 13, 16, 24, 25, 33, 39, 42, 43, 45, 48, 49, 50, 53, 54, 55, 58, 60, 63, 66, 69, 75, 76, 77, 82, 86, 88, 91, 92, 93, 93:1, 94, 95, 96, 97, 98, 99, 100, 102, 103, 104, 106 or 107, Dianix violet cc, and dyes with CAS-No's 42783-06-2, 210758-04-6, 104366-25-8, 122063-39-2, 167940-11-6, 52239-04-0, 105076-77-5, 84425-43-4, and 87606-56-2.

The following are preferred non-azo dyes: Disperse Blue 250, 354, 364, 366, Solvent Violet 8, solvent blue 43, solvent blue 57, Lumogen F Blau 650, and Lumogen F Violet 570.

It is preferred that the dye is fluorescent.

The composition may also comprise between 0.0001 to 0.1 wt % of one or more other dyes selected from cotton substantive shading dyes of group consisting of: hydrolysed reactive dye; acid dye; and direct dye.

Balance Carriers and Adjunct Ingredients

The laundry treatment composition in addition to the dye comprises the balance carriers and adjunct ingredients to 100 wt % of the composition.

These may be, for example, surfactants, builders, foam agents, anti-foam agents, solvents, fluorescers, bleaching agents, and enzymes. The use and amounts of these components are such that the composition performs depending upon economics, environmental factors and use of the composition.

The composition may comprise a surfactant and optionally other conventional detergent ingredients. The composition may also comprise an enzymatic detergent composition which comprises from 0.1 to 50 wt %, based on the total detergent composition, of one or more surfactants. This surfactant system may in turn comprise 0 to 95 wt % of one or more anionic surfactants and 5 to 100 wt % of one or more nonionic surfactants. The surfactant system may additionally contain amphoteric or zwitterionic detergent compounds, but this in not normally desired owing to their relatively high cost. The enzymatic detergent composition according to the invention will, generally be used as a dilution in water of about 0.05 to 2 wt %.

It is preferred that the composition comprises between 2 to 60 wt % of a surfactant, most preferably 10 to 30 wt %. In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Perch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$ to $C_{22}$ alkyl phenol-ethylene oxide condensates, generally 5 to 25 EO, i.e. 5 to 25 units of ethylene oxide per molecule, and the condensation products of aliphatic $C_8$ to $C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$ to $C_{15}$ alkyl benzene sulphonates and sodium $C_{12}$ to $C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed, out in EP-A-346 995 (Unilever). Especially preferred is surfactant system that is a mixture of an alkali, metal salt of a $C_{16}$ to $C_{18}$ primary alcohol sulphate together with a $C_{12}$ to $C_{15}$ primary alcohol 3 to 7 EO ethoxylate.

The nonionic detergent is preferably present in amounts greater than 10%, e.g. 25 to 90 wt % of the surfactant system. Anionic surfactants can be present for example in amounts in the range from about 5% to about 40 wt % of the surfactant system.

Cationic Compound

When the present invention is used as a fabric conditioner it needs to contain a cationic compound.

Most preferred are quaternary ammonium compounds.

It is advantageous if the quaternary ammonium compound is a quaternary ammonium compound having at least one $C_{12}$ to $C_{22}$ alkyl chain.

It is preferred if the quaternary ammonium compound has the following formula:

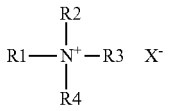

in which $R^1$ is a $C_{12}$ to $C_{22}$ alkyl or alkenyl chain; $R^2$, $R^3$ and $R^4$ are independently selected from $C_1$ to $C_4$ alkyl chains and $X^-$ is a compatible anion. A preferred compound of this type is the quaternary ammonium compound cetyl trimethyl quaternary ammonium bromide.

A second class of materials for use with the present invention are the quaternary ammonium of the above structure in which $R^1$ and $R^2$ are independently selected from $C_{12}$ to $C_{22}$ alkyl or alkenyl chain; $R^3$ and $R^4$ are independently selected from $C_1$ to $C_4$ alkyl chains and $X^-$ is a compatible anion.

A detergent composition according to claim 1 in which the ratio of (ii) cationic material to (iv) anionic surfactant is at least 2:1.

Other suitable quaternary ammonium compounds are disclosed in EP 0 239 910 (Proctor and Gamble).

It is preferred if the ratio of cationic to nonionic surfactant is from 1:100 to 50:50, more preferably 1:50 to 20:50.

The cationic compound may be present from 0.02 wt % to 20 wt % of the total weight of the composition.

Preferably the cationic compound may be present from 0.05 wt % to 15 wt %, a more preferred composition range is from 0.2 wt % to 5 wt %, and most preferably the composition range is from 0.4 wt % to 2.5 wt % of the total weight of the composition.

If the product is a liquid it is preferred if the level of cationic surfactant is from 0.05 wt % to 10 wt % of the total weight of the composition. Preferably the cationic compound may be present from 0.2 wt % to 5 wt %, and most preferably from 0.4 wt % to 2.5 wt % of the total weight of the composition.

If the product is a solid it is preferred if the level of cationic surfactant is 0.05 wt % to 15 wt % of the total weight of the composition. A more preferred composition range is from 0.2 wt % to 10 wt %, and the most preferred composition range is from 0.9 wt % to 3.0 wt % of the total weight of the composition.

Bleaching Species

The laundry treatment composition may comprise bleaching species. The bleaching species, for example, may selected from perborate and percarbonate. These peroxyl species may be further enhanced by the use of an activator, for example, TAED or SNOBS. Alternatively or in addition to, a transition metal catalyst may used with the peroxyl species. A transition metal catalyst may also be used in the absence of peroxyl species where the bleaching is termed to be atmospheric oxygen, see, for example WO02/48301. Photobleaches, including singlet oxygen photobleaches, may be used with the laundry treatment composition. A preferred photobleach is vitamin K3.

Fluorescent Agent

The laundry treatment composition most preferably comprises a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in laundry treatment composition is generally from 0.005 to 2 wt %, more preferably 0.01 to 0.1 wt %. Preferred classes of fluorescer are: Di-styryl biphenyl compounds, e.g. Tinopal (Trade Mark) CBS-X, Di-amine stilbene di-sulphonic acid compounds, e.g., Tinopal DMS pure Xtra and Blankophor (Trade Mark) HRH, and Pyrazoline compounds, e.g. Blankophor SN. Preferred fluorescers are: sodium 2 (4-styryl-3-sulfophenyl)-2H-napthol [1,2-d]trazole, disodium 4,4'-bis{[(4-anilino-6-(N methyl-N-2 hydroxyethyl) amino 1,3,5-triazin-2-yl)] amino}stilbene-2-2' disulfonate, disodium 4,4'-bis{[(4-anilino-6-morpholino-1,3,5-triazin-2-yl)]amino}stilbene-2-disulfonate, and disodium 4,4'-bis(2-sulfoslyryl)biphenyl.

EXAMPLES

Example 1

Approximately 1000 ppm solutions of the dyes listed in the table below, were made in ethanol.

A stock solution of 1.8 g/L of a base washing powder in water was created. The washing powder contained 13% NaLAS, 73% salts (silicate, sodium tri-poly-phosphate, sulphate, carbonate), 3% minors including perborate, fluorescer and enzymes, remainder impurities and water. The solution was divided into 100 ml aliquots and the solvent dyes added from the ethanol solutions to give 5.8 ppm solutions. 1 g of pure woven polyester fabric was added to each of the wash solutions and the solution then shaken for 30 minutes, rinsed and dried. From the colour of the fabric it was clear that dye had deposited to the fabric. To quantify this the colour was measured using a reflectance spectrometer and expresses as the deltaE value compared to a polyester washed analogously but without dye present.

The results are given below

| Dye | Dye-ppm in solution | deltaE |
|---|---|---|
| No dye (to indicate error level) | 0 | 0.2 |
| 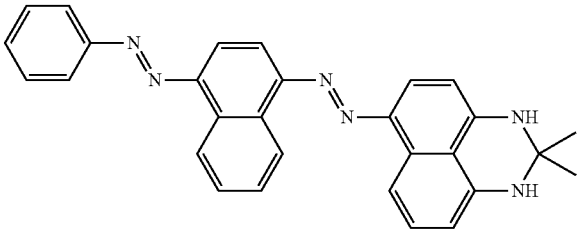 solvent black 3 | 5.7 | 5.0 |

-continued

| Dye | Dye-ppm in solution | deltaE |
|---|---|---|
| 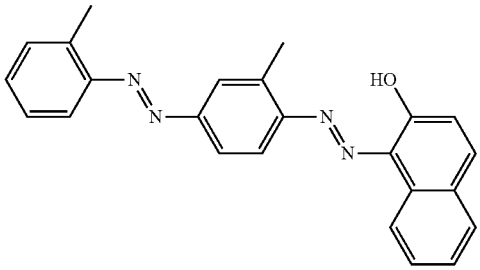 solvent red 24 | 5.8 | 10.6 |
| 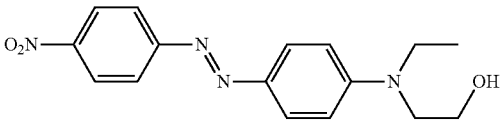 disperse red 1 | 5.8 | 10.9 |
| 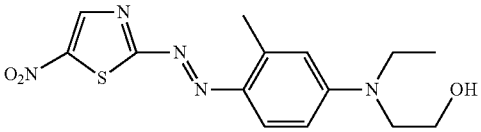 disperse blue 106 | 5.8 | 4.8 |

Example 2

50 ppm solutions of the dyes listed in the table below, were made in ethanol. Concentration refers to dyes as received from the supplier. In general solvent dyes are pure (>90%) and disperse dyes have purities in the range 20-50%.

A stock solution of 1.8 g/L of a base washing powder in water was created. The washing powder contained 18% NaLAS, 73% salts (silicate, sodium tri-poly-phosphate, sulphate, carbonate), 3% minors including perborate, fluorescer and enzymes, remainder impurities and water. The solution was divided into 100 ml aliquots and the dyes added from the ethanol solutions with rapid stirring to give 200 ppb solutions. 1 g of pure knitted polyester fabric was added to each of the wash solutions and the solution then shaken for 30 minutes, rinsed and dried. From the colour of the fabric it was clear that dye had deposited to the fabric. To quantify this the colour was measured using a reflectance spectrometer and expresses as the delta E value compared to a polyester washed analogously but without dye present. Following the washes the Ganz whiteness of the cloth was also measured (see "assessment of Whiteness and Tint of Fluorescent Substrates with Good Instrument Correlation" *Colour Research and Application* 19, 1994).

The experiments were repeated using knitted nylon as a fabric type.

The results are displayed in the table below.

| Dye Maximum visible absorption wavelength in ethanol given. | OD 10 cm | Ganz | ΔE polyester | ΔE nylon | CT |
|---|---|---|---|---|---|
| Control | 0 | 81 | 0.1 | 0.4 | — |
| 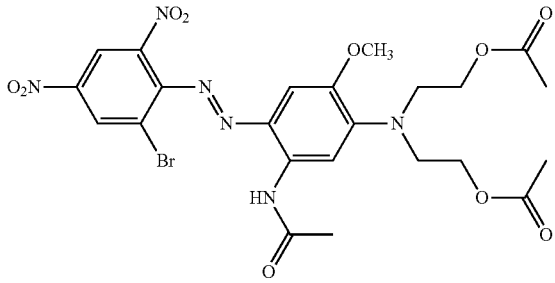 Disperse Blue 79:1 (576 nm) LogP = 4.5 | 0.048 | 113 | 4.7 | 1.7 | 96 |

-continued

| Dye<br>Maximum visible absorption<br>wavelength in ethanol given. | OD<br>10 cm | Ganz | ΔE<br>polyester | ΔE<br>nylon | CT |
|---|---|---|---|---|---|
| 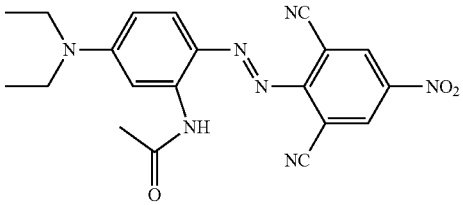 <br>Disperse Blue 165 (611 nm)<br>LogP = 3.5 | 0.014 | 129 | 7.5 | 5.0 | 107 |
| Disperse Blue 367 (610 nm) | 0.0067 | 91 | 1.4 | 1.1 | 250 |
| Solvent blue 43 | 0.33 | 88 | 0.9 | 0.4 | 2.1 |
| Triphenylmethane (602 nm) | | | | | |
| Lumogen F Blau 650 (ex BASF) | — | 88 | 0.3 | 0.6 | — |
| Lumogen F Violett 570 (ex BASF) | — | 87 | 0.1 | 0.2 | — |
| 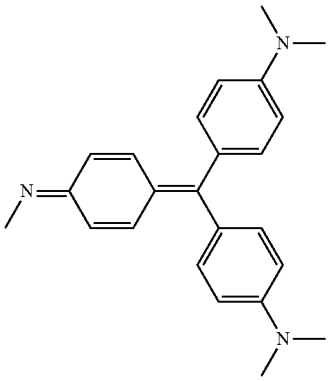 <br>Solvent Violet 8 (Methyl Violet B Base) (580 nm)<br>LogP = 4.5 | 0.26 | 89 | 1.1 | 0.6 | 3.5 |
| 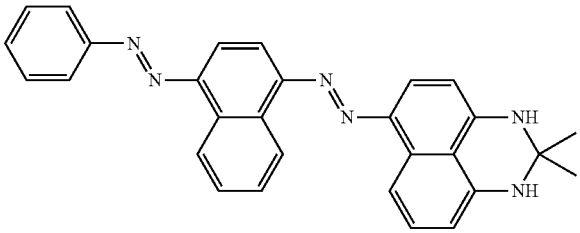 <br>solvent black 3 (604 nm)<br>logP = 8.5 | 0.11 | 74 | 1.5 | 0.6 | 6.4 |
| Dianix Violet CC (550 nm) (ex Dystar) | 0.013 | 132 | 8.0 | 7.5 | 623 |

-continued

| Dye<br>Maximum visible absorption<br>wavelength in ethanol given. | OD<br>10 cm | Ganz | ΔE<br>polyester | ΔE<br>nylon | CT |
|---|---|---|---|---|---|
| 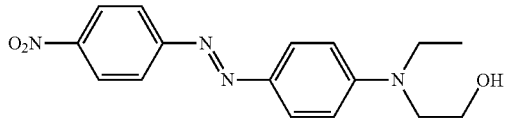 <br>Disperse red 1 (482 nm)<br>LogP = 4.0 | 0.023 | 71 | 3.4 | 11.8 | 150 |

Table-notes

The ganz whiteness values are accurate to +/−5 units.

All deltaE measurements are UV excluded.

Only where known is the structure of the dye given.

The optical density, OD, is that of a 200 ppb solution in water at 10 cm. The value was obtained by extrapolated from measurement in ethanol solutions at higher levels for accuracy.

CT is a measure of the Colour Transferred from the wash solution to the polyester and is defined as: CT = deltaE/OD From the deltaE results in the table all the dyes coloured the polyester.

From the Ganz results, dyes which are blue or violet increase the whiteness. The Black and red dyes decrease the whiteness.

The lumogen dyes add fluorescence to the polyester, as observed by eye in a light box with UV-irradiation.

Example 3

The experiment of example 2 was repeated, but using 40 ppb of the dyes listed below. The L:C was changed to 30:1 and consisted by weight of 43% woven polyester and 57% non-mercerised cotton sheeting. The Ganz whiteness of the polyester was 89 for disperse blue 79:1. Whiteness benefits were also observed on the cotton. Repetition of the experiment using nylon, also gave benefits.

We claim:

1. A method of treating a textile garment, the method comprising the steps of:

(i) treating a polyester-containing textile with an aqueous solution of a hydrophobic dye, the aqueous solution comprising from 1 ppb to 6 ppm of the hydrophobic dye and from 0.2 g/L to 3 g/L of a surfactant; and (ii) rinsing and drying the textile, wherein the hydrophobic dyes are devoid of polar solubilizing groups, and wherein the hydrophobic dye is selected from a group consisting of benzodifuranes, methine, napthalimides, pyrazole, napthoquinone, a mono-azo dye, a di-azo dye, and a mixture thereof.

2. The method of treating a textile garment of claim 1, wherein the aqueous solution comprises from 1 ppb to 5 ppm of the hydrophobic dye.

3. The method of treating a textile garment of claim 2, wherein the aqueous solution comprises from 10 ppb to 200 ppb of the hydrophobic dye.

4. The method of treating a textile garment of claim 1, wherein the hydrophobic dye is mono-azo dye, di-azo dye, or a combination thereof.

5. The method of treating a textile garment of claim 1, wherein the dye gives a blue or violet shade when deposited on white polyester.

6. The method of treating a textile garment of claim 1, wherein the surfactant is a mixture of at least one anionic surfactant and at least one nonionic surfactant, wherein the at least one nonionic surfactant is present in an amount greater than 10 wt % of the total surfactant.

7. The method of treating a textile garment of claim 1, wherein the aqueous solution has an ionic strength from 0.001 to 0.5.

8. The method of treating a textile garment of claim 1, wherein the aqueous solution further comprises an enzyme, a bleaching agent, or both.

9. The method of treating a textile garment of claim 1, wherein the hydrophobic dye is a di-azo dye.

* * * * *